United States Patent [19]

Sorenson

[11] 4,039,077

[45] Aug. 2, 1977

[54] RESTRAINING PAD FOR SINK PACKAGES

[75] Inventor: John F. Sorenson, Minneapolis, Minn.

[73] Assignee: Hoerner Waldorf Corporation

[21] Appl. No.: 710,448

[22] Filed: Aug. 2, 1976

[51] Int. Cl.[2] ..... B65D 5/50; B65D 75/04; B65D 81/14

[52] U.S. Cl. ..... 206/320; 206/476; 206/586; 229/14 C; 229/40

[58] Field of Search ..... 206/320, 427, 453–454, 206/476, 491, 521, 326, 586, 592, 594; 229/14 C, 16 R, 40, DIG. 1

[56] References Cited

U.S. PATENT DOCUMENTS

| | | | |
|---|---|---|---|
| 2,620,062 | 12/1952 | Schuler | 229/40 X |
| 3,586,234 | 6/1971 | Nathan et al. | 229/40 |
| 3,780,933 | 12/1973 | Freeman | 206/594 X |

*Primary Examiner*—Steven E. Lipman
*Attorney, Agent, or Firm*—Jerry F. Best

[57] ABSTRACT

A die cut pad made from corrugated paperboard for use in protecting a sink during shipment in a rectangular carton, the pad being one which folds over upon itself and has a die cut section which may extend down into the cavity in a similarly placed section on the opposite side which is positioned against the outside of the cavity and serves to hold the sink or suspend it away from the side panels of the carton.

1 Claim, 3 Drawing Figures

RESTRAINING PAD FOR SINK PACKAGES

BACKGROUND OF THE INVENTION

1. Field of the Invention

This invention relates generally to means for packaging particular items such as recessed well sinks and more particularly to pads adapted to be fitted to the sink before it is placed inside an outer carton to protect the sink and suspend it within the walls of the carton.

2. Description of the Prior Art

There is a constant demand in all fields of packaging to improve the resistance of any given package to damage from forces outside the carton as well as damage which may occur to the contents from movement within the carton.

SUMMARY OF THE INVENTION

A die cut pad which may be folded over itself and slipped on the ends or flanges of a recessed sink, the pad having two sections, one of which may be pushed down into the bowl of the sink to help hold it in position and a second which is positioned against the outside of the bowl to suspend the assembly from the surface of the outer carton.

DETAILED DESCRIPTION OF THE PREFERRED EMBODIMENT

Stainless steel sinks which are to be shipped prior to installation are made of a gauge of metal which may be dented and the surface of the stainless steel sink is one which may be subject to marring if the abrasive surface of the corrugated paperboard is allowed to vibrate against it. If the sink is one which is enameled, it is important that no sharp blows be directed against the surface since it may chip or otherwise scratch. The pad which is the subject of the present invention is one which is adapted to protect a sink 10 which includes either a single or double well shown generally as 11 and which has a flange 12 extending around the perimeter thereof. The pad is one which is formed from a die cut blank 13 which is substantially rectangular in shape and which has two vertical fold lines 14 and 15 positioned near the center thereof and spaced apart a distance substantially equal to or slightly greater than the thickness of the flange 12 around the perimeter of the sink 10.

Figure 2:
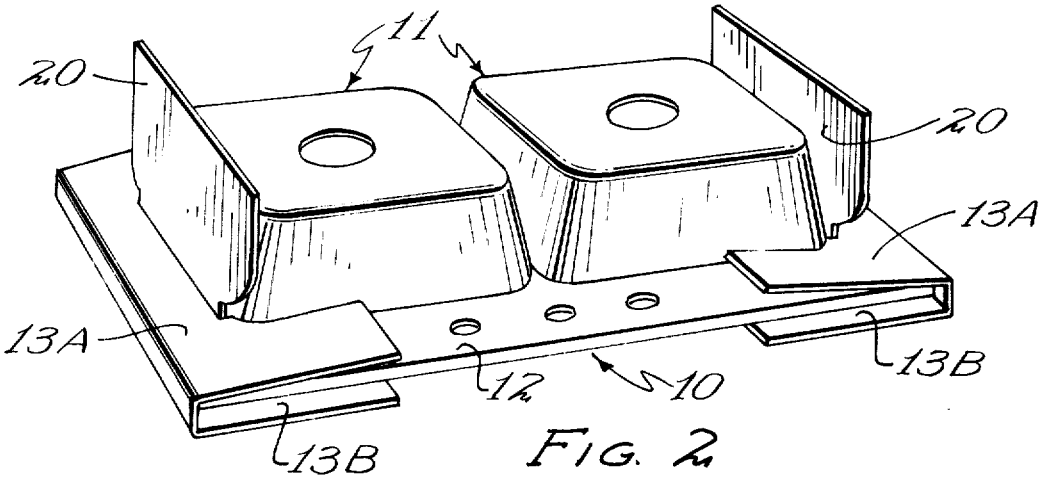
FIG. 2 is a perspective view of a double well sink assembled with two pads such as that shown in FIG. 1.
Figure 3:
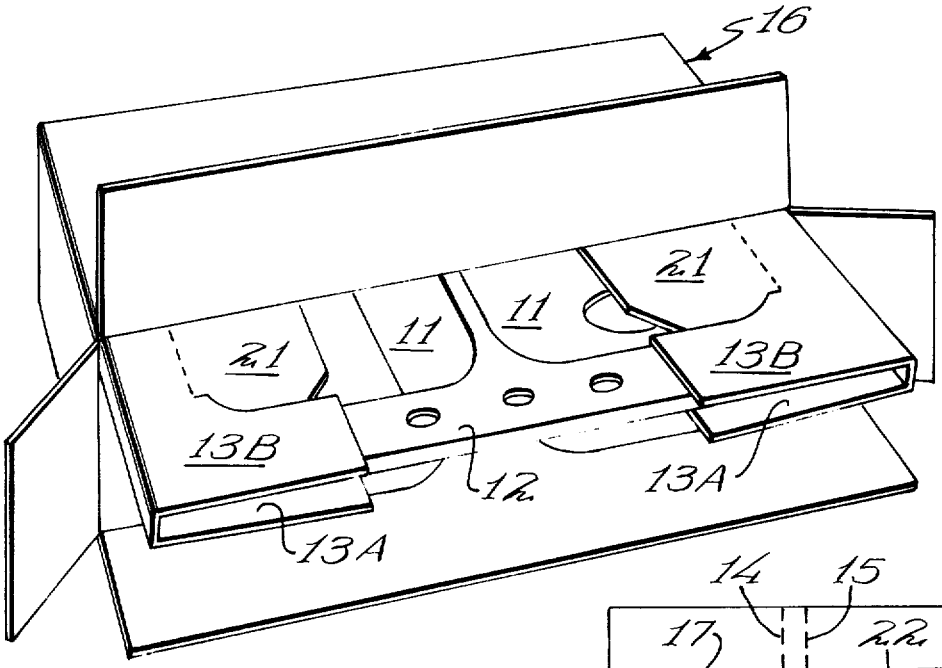
FIG. 3 is a perspective view of the sink and pads shown in FIG. 2 as they are positioned in a carton.
Figure 1:
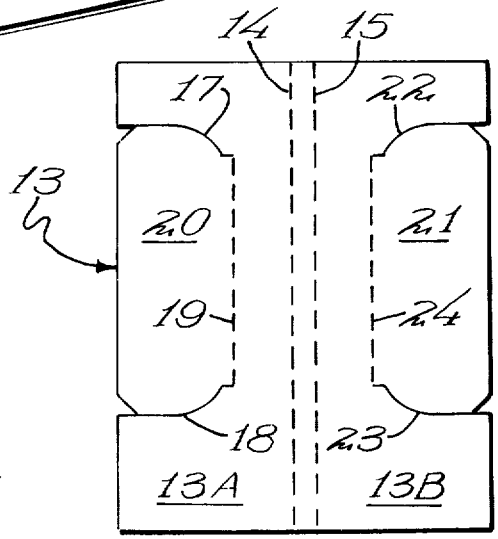
FIG. 1 is a plan view of a blank of the type which is the subject of the present invention.

The pad has cut in each side 13A and 13B defined by the parallel fold lines 14 and 15 a restraining section which is either foldable down into the well of the sink or foldable into a plane substantially normal to the flange 12 of the sink 10 to help position the assembly on the outer surfaces of the carton, which is shown in FIG. 3 as 16. On the left side of the blank in FIG. 1 is a die cut area 20 which has one surface the outer lateral edge of the blank and is defined on its top and bottom edges by line cuts 17 and 18 which are curvilinear to a connecting vertical hinge line 19 serving to connect the section, which is identified as 20, to the rest of the blank 13. Similarly on the opposite side is a section 21 defined by top and bottom cut lines 22 and 23 and connected by a vertical fold line 24.

As can be seen in the drawings when the blank 13 is folded over upon itself one of the sections lies in close exterior relationship to the perimeter of the wells 11 and the other, in this case section 21, is positioned and die cut in such a shape that it may be pressed down into the well of the sink so that the sink will not move relative to the pad during shipment.

The particular embodiment shown is for a double well sink and two pads are used, but it should be understood that this style pad can be used for a single well sink, and since the wells 11 are not spaced in the exact geometric center of the assembly, it is necessary to off-set the sections 20 and 21 to one end. That being the case, it is necessary to allow double-fold or reverse-fold type score lines on the blank so that the blank may be folded in either direction to allow a single pad blank to be used for either end of the sink.

I claim:

1. A package for storing and shipping a sink having at least one recessed well and a planar flange which is relatively thin in cross section, said package comprising:

a sink;

a pair of die cut sink restraining pads, one each of said pads positioned at the respective ends of said sink and partially folded to engage the flange of said sink;

each of said pads being folded into a generally U-shaped configuration with parallel sides and a narrow connecting section;

each side in each of said pads having formed therein an area which is defined by line cuts and a hinge line, said areas being moved downwardly into said wells of said sink and outwardly to lie in close relationship to the exterior perimeter of the well;

said sink and said pads located within a rectangular outer carton, the respective edges and surfaces of said pads preventing contact between said sink and said carton.

* * * * *